US006209763B1

(12) United States Patent
Rahmey

(10) Patent No.: US 6,209,763 B1
(45) Date of Patent: Apr. 3, 2001

(54) HANGING PACKAGE DISPLAY UNIT

(76) Inventor: Jack Rahmey, 220 Monmouth Rd., Oakhurst, NJ (US) 07755

( * ) Notice: Subject to any disclaimer, the term of this patent is extended or adjusted under 35 U.S.C. 154(b) by 0 days.

(21) Appl. No.: 09/501,111

(22) Filed: Feb. 9, 2000

(51) Int. Cl.[7] ..... A47G 25/18
(52) U.S. Cl. ..... 223/88; 223/87
(58) Field of Search ..... 223/85, 88, 92, 223/87, 95

(56) References Cited

U.S. PATENT DOCUMENTS

| | | | | |
|---|---|---|---|---|
| 2,753,143 | * | 7/1956 | Berlt | 223/88 |
| 3,935,976 | | 2/1976 | Mizrach . | |
| 4,416,401 | * | 11/1983 | King | 223/88 |
| 4,646,951 | * | 3/1987 | Gasser | 223/87 |
| 5,127,559 | * | 7/1992 | Freer et al. | 223/85 |
| 5,728,440 | | 3/1998 | Good . | |
| 5,803,321 | * | 9/1998 | Willinger et al. | 223/88 |
| 6,105,834 | * | 8/2000 | Cohen | 223/88 |

* cited by examiner

*Primary Examiner*—Bibhu Mohanty
(74) *Attorney, Agent, or Firm*—Ezra Sutton

(57) ABSTRACT

A hanging package display unit for holding and displaying multiple sets of various clothing articles. The hanging package display unit includes a first hanger having a pair of arm holding members and a central neck member, with the neck member having a hook member and a receiving slot formed therein. The display unit also includes a second hanger having a pair of arm holding members and a central neck member, with the neck member having a hook member. The second hanger is disposed below the first hanger and connected thereto, wherein the hook member of the second hanger is received within the receiving slot of the first hanger. The hanger package display unit further includes a central hole formed in the neck member of the first hanger for receiving therein a securing device for holding together in a secure fashion the interlocked first and second hangers. Additionally, the hanger package display unit also includes a packaging display card having indicia thereon for partially surrounding the first and second hangers in order to hold together both of the first and second hangers securely in place.

7 Claims, 10 Drawing Sheets

HANGING PACKAGE DISPLAY UNIT

FIELD OF THE INVENTION

This invention relates to a hanging package display unit for displaying multiple units of various articles of clothing such as underwear, blouses and slacks, shirt and pants, woman's pants suit, sleepwear and the like. More particularly, the hanging package display unit includes a first hanger and a second hanger interlocked below the first hanger, where the interlocked second hanger is received within a slot opening in the neck member of the first hanger, and the two hangers are held together by a surrounding packaging display card having advertising and/or display indicia thereon.

BACKGROUND OF THE INVENTION

Prior art methods of packaging clothing articles for hanging display typically include a single hanger and a header card and/or hanging tab which is attached to the clothing article and/or hanger for hanging on a display rack. At present, there is no hanger system for displaying two or more clothing articles on multiple hangers for hanging on a display rack.

There remains a need for a hanging package display unit for displaying multiple units of various clothing articles, such as underwear, blouses and slacks, shirt and pants, women's pants suits and the like. The display unit would include two or more hangers connected to each other by a surrounding packaging card having advertising and/or display indicia thereon.

DESCRIPTION OF THE PRIOR ART

Multiple garment hangers and product display hangers having various designs, structures, configurations and materials of construction have been disclosed in the prior art. For example, U.S. Pat. No. 3,935,976 to Mizrach discloses a multiple garment hanger. This prior art patent does not disclose or teach two hangers interlocked having a display card thereon for holding the two hangers together.

U.S. Pat. No. 5,728,440 to Good discloses a product display hanger. This prior art patent does not disclose or teach two hangers interlocked having a display card thereon for holding the two hangers together.

None of the aforementioned prior art patents disclose or teach the present invention of a hanging package display unit having two hangers connected or interlocked and having a display card thereon for holding the two hangers together.

Accordingly, it is an object of the present invention to provide a hanging package display unit for displaying multiple units of various clothing articles, such as underwear and bras, blouses and slacks, shirt and pants, pants suits (for women) and the like.

Another object of the present invention is to provide a hanging package display unit that displays two or more clothing articles on multiple hangers for hanging on a display rack.

Another object of the present invention is to provide a hanging package display unit that includes a first hanger and a second hanger interlocked below the first hanger, where the interlocked second hanger is received within a slot opening in the neck member of the first hanger.

Another object of the present invention is to provide a hanging package display unit where the two interlocked hangers are held together by a surrounding packaging display card having advertising and/or display indicia thereon.

Another object of the present invention is to provide a hanging package display unit where the two connected hangers are held together by a security tie within a hole opening in the neck member of the first hanger.

Another object of the present invention is to provide a hanging package display unit that includes a hanging bracket member integrally attached to each of the two interlocked hangers for hanging at least four articles of clothing thereon.

Another object of the present invention is to provide a hanging package display unit where the packaging display card may display additional clothing and non-clothing and nonclothing accessories such as matching slippers, neckties, toys, booklets and the like being mounted on the front side of the packaging display card.

Another object of the present invention is to provide a hanging package display unit wherein the materials of construction are selected from the group consisting of plastics, wood, paper and light-weight metals.

A further object of the present invention is to provide a hanging package display unit that can be mass produced in an automated and economical manner and is readily affordable to the clothing manufacturer or retailer.

SUMMARY OF THE INVENTION

In accordance with the present invention, there is provided a hanging package display unit for holding and displaying multiple sets of various clothing articles. The hanging package display unit includes a first hanger having a pair of arm holding members and a central neck member, with the neck member having a hook member and a receiving slot formed therein. The display unit also includes a second hanger having a pair of arm holding members and a central neck member, with the neck member having a hook member. The second hanger is disposed below the first hanger and connected thereto, wherein the hook member of the second hanger is received within the receiving slot of the first hanger. The hanger package display unit further includes a central hole formed in the neck member ofthe first hanger for receiving therein a securing device for holding together in a secure fashion the interlocked first and second hangers. Additionally, the hanger package display unit also includes a packaging display card having indicia thereon for partially surrounding the first and second hangers in order to hold together both of the first and second hangers securely in place.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE EMBODIMENTS

PREFERRED EMBODIMENT 10

Figure 4:
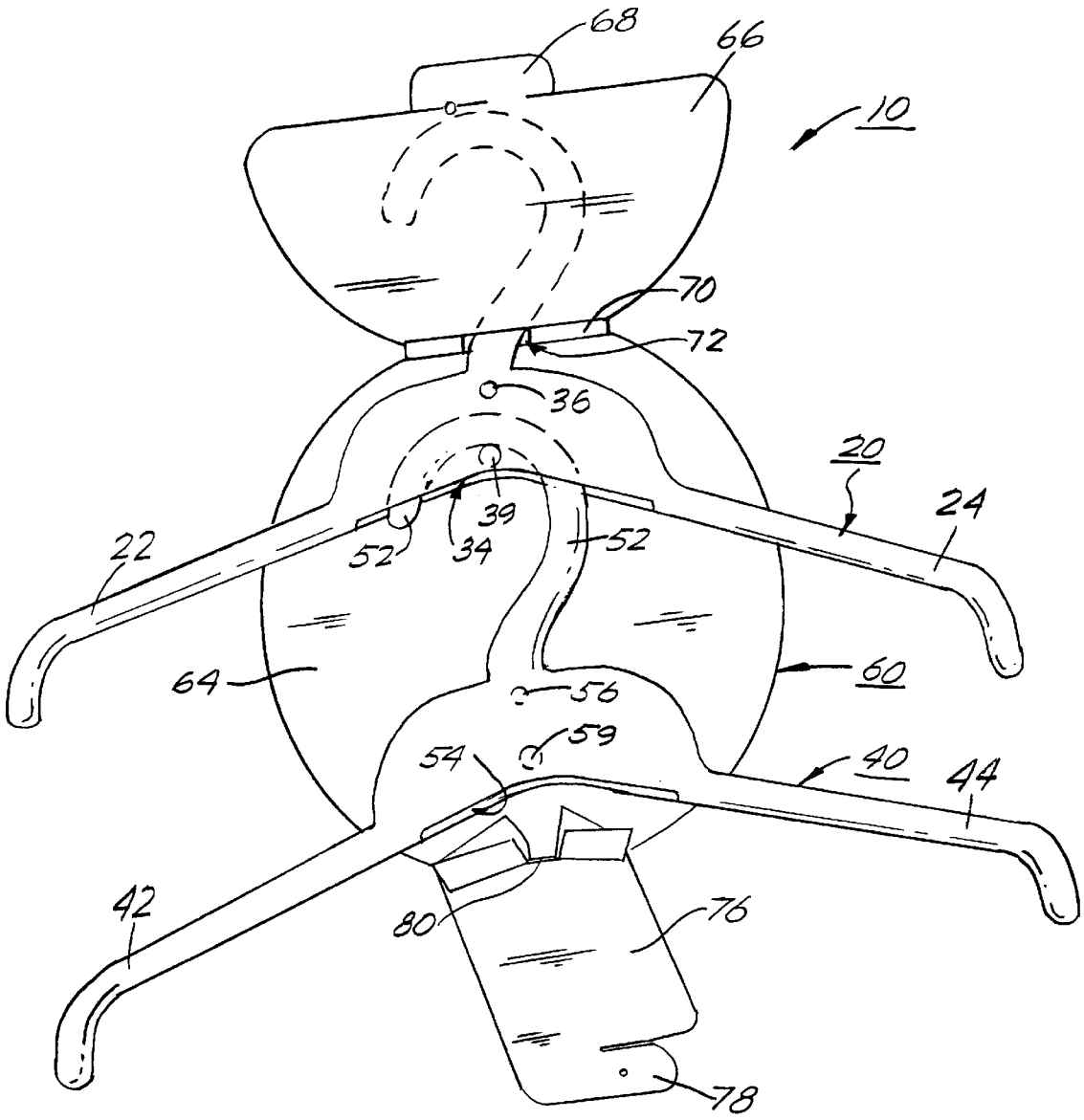
FIG. 4 is a rear perspective view of the hanging package display unit of the preferred embodiment of the present invention showing the packaging display card in the process of being attached to the interlocked upper and lower hangers.
Figure 5:
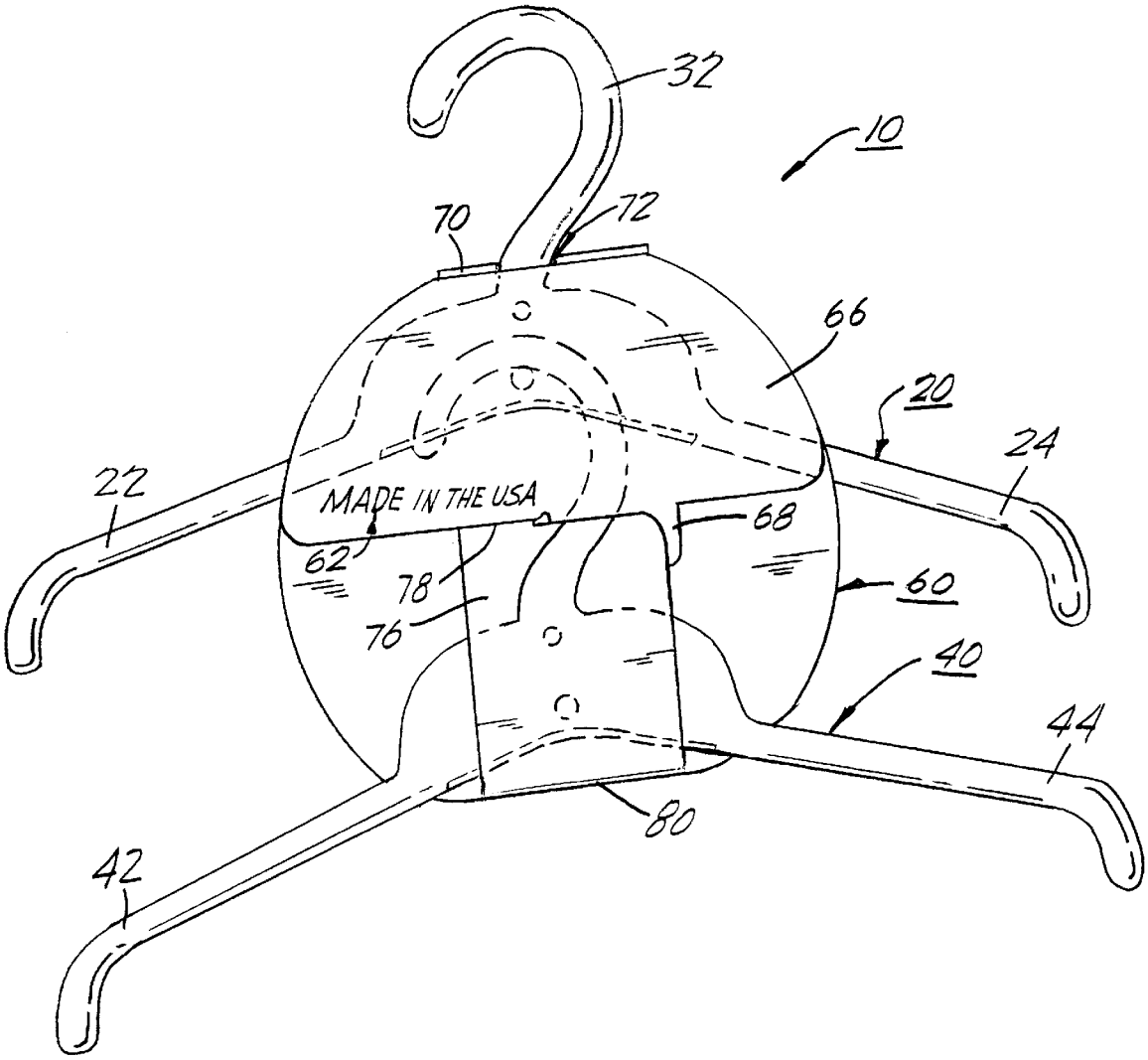
FIG. 5 is a rear perspective view of the hanging package display unit of the preferred embodiment of the present invention showing the upper and lower hangers interlocked and held together by a surrounding packaging display card having indicia thereon.
Figure 6:
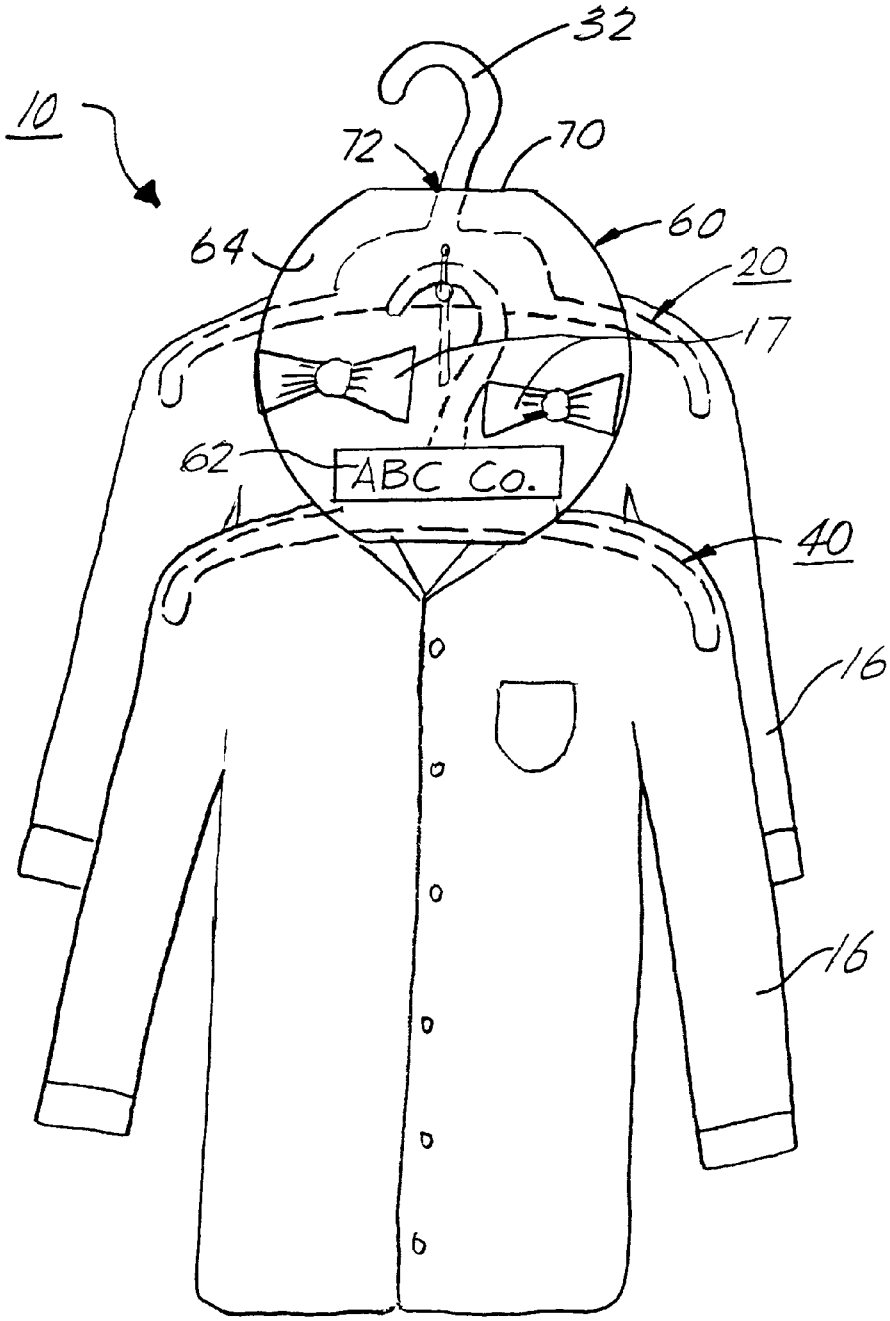
FIG. 6 is a front view of the hanging package display unit of the preferred embodiment of the present invention showing the upper and lower hangers having the packaging display card thereon and in operational use.

The hanging package display units 10, 100 and 200 and their component parts of the preferred and alternate embodiments of the present invention are represented in detail by FIGS. 1 through 10 of the patent drawings. The hanging package display unit 10 of the preferred embodiment is used for displaying multiple units of various articles of clothing, as shown in FIG. 6, such as shirts 16, pajama night shirts, underwear, bras, blouses, jackets, coats and the like. The hanging package display unit 10, as shown in FIGS. 1 to 6 of the drawings, includes a first (upper) hanger 20 and a second (lower) hanger 40 interlocked below the upper first hanger 20. The hook member 52 of the interlocked lower second hanger 40 is received within a slot opening 34 formed in the neck member 30 of the upper first hanger 20, and the upper and lower hangers 20 and 40 are held together by a surrounding packaging display card 60 having advertising and/or display indicia 62 thereon.

Figure 1:
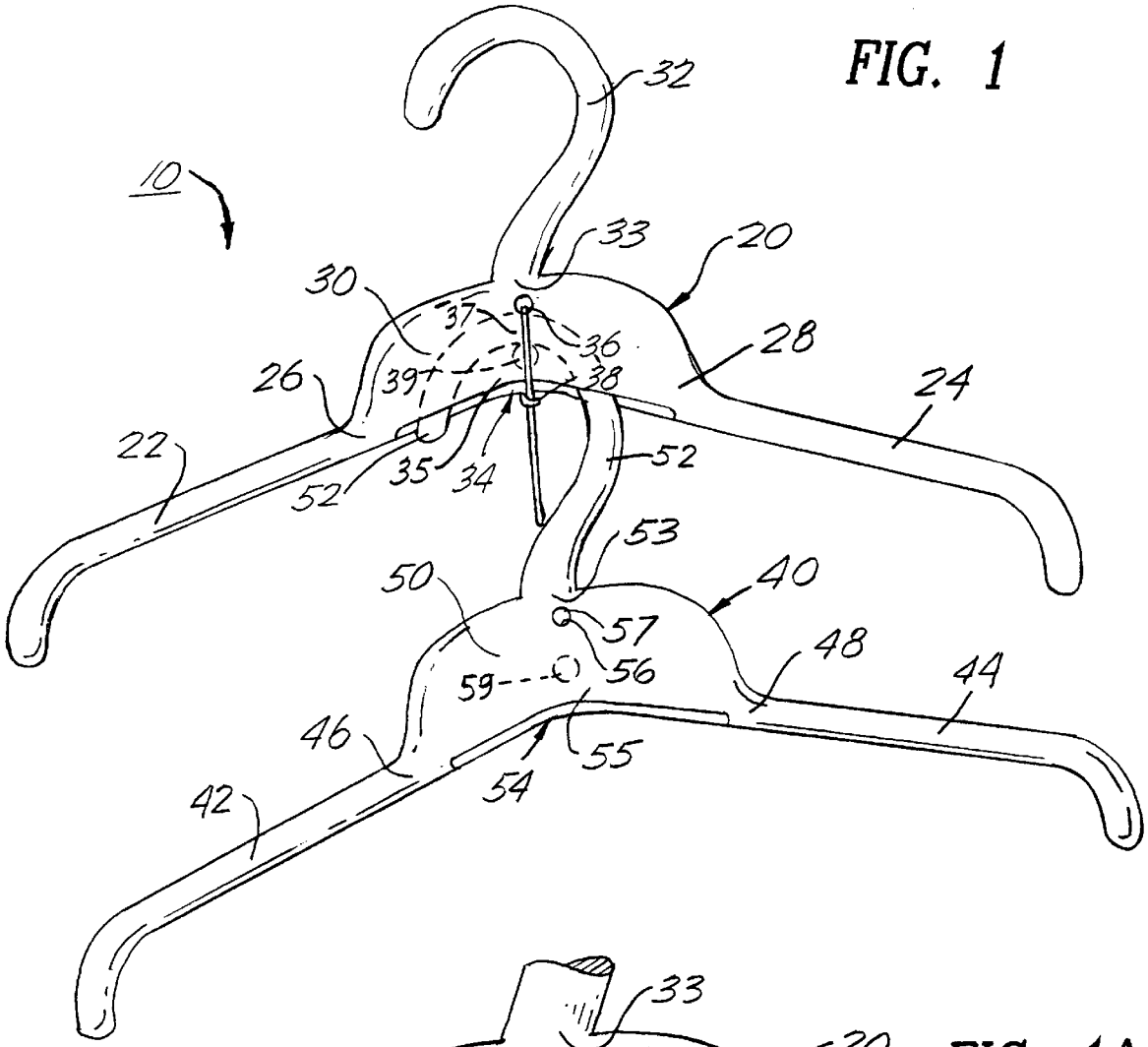
FIG. 1 is a perspective view of the hanging package display unit of the preferred embodiment of the present invention showing an upper hanger and a lower hanger interlocked below the upper hanger, and showing the hanger hook of the interlocked lower hanger received within a slot opening in the neck member of the upper hanger, and having a securing tie member for preventing the separation of the lower hanger from the upper hanger.
Figure 1A:
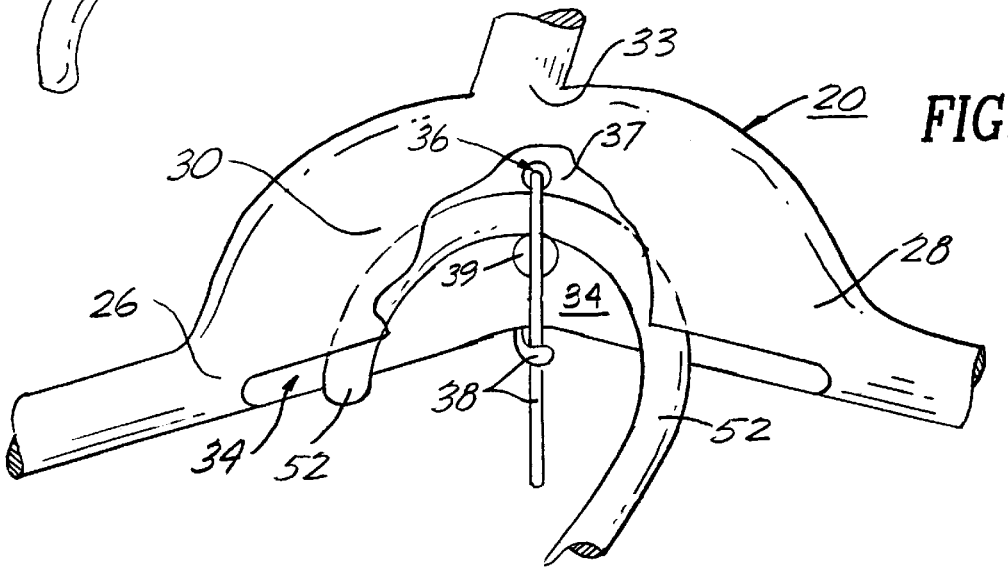
FIG. 1A is an enlarged perspective view of the hanging package display unit of the preferred embodiment of the present invention showing the hanger hook ofthe lower hanger received on the bar member within the receiving slot opening of the neck member of the upper hanger, and having a securing tie member for preventing the separation of the lower hanger from the upper hanger.
Figure 2:
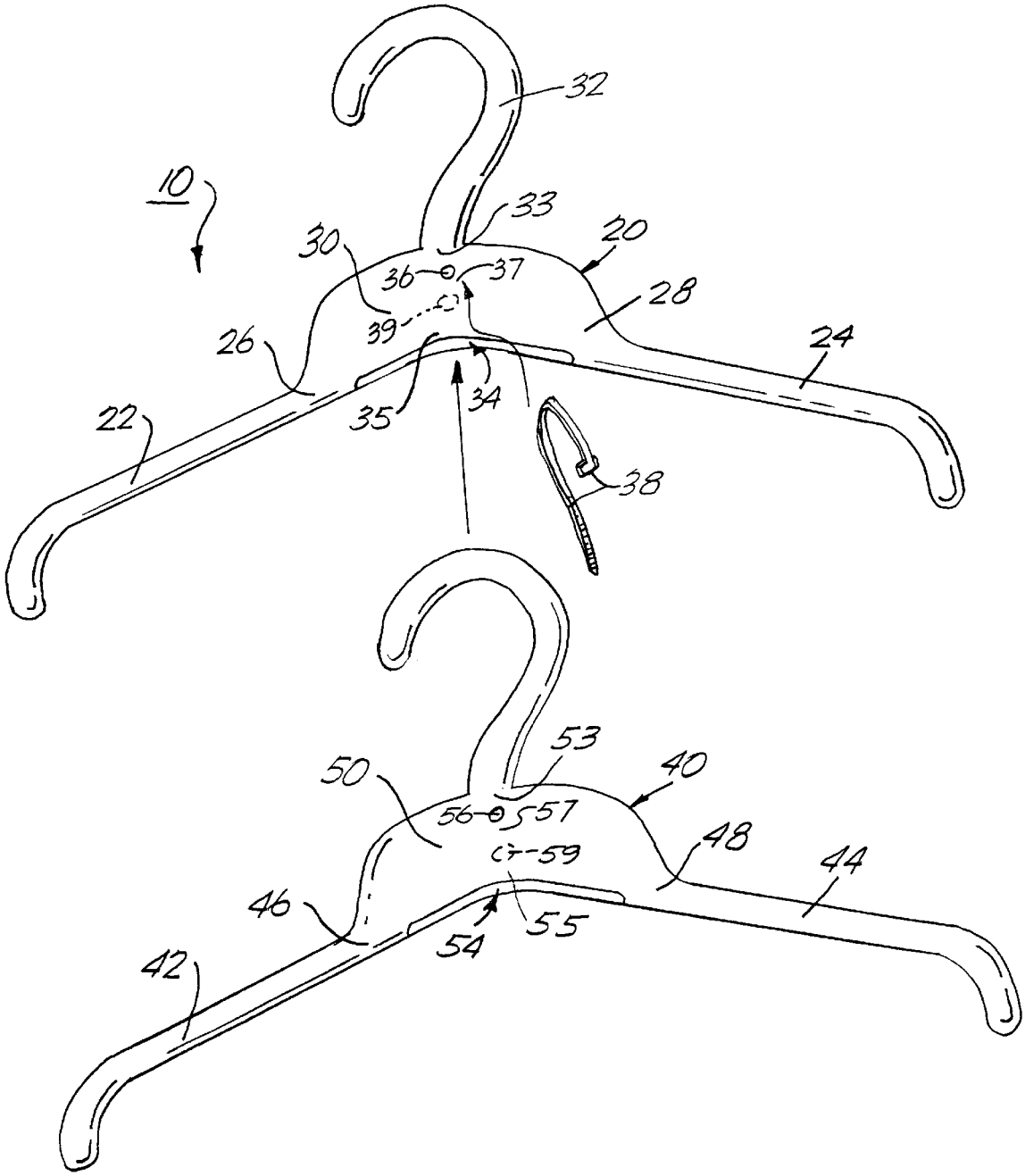
FIG. 2 is an exploded perspective view of the hanging package display unit of the preferred embodiment of the present invention showing the interlocking of the hanger hook of the lower hanger within the slot opening of the neck member of the upper hanger, and showing the securing tie member received within the hole opening of the neck member of the upper hanger for securing together the interlocked upper and lower hangers.

The upper first hanger 20 includes a pair of hanger arm holding members 22 and 24, each having inner ends 26 and 28, respectively, as shown in FIGS. 1 and 2 of the drawings. Each of the inner ends 26 and 28 are integrally connected to the neck member 30. Neck member 30 includes a hook member 32 being located at the upper end 33 of neck member 30. Neck member 30 also includes a slot opening 34 having a supporting bar member 39 therein being located at the lower end 35 of neck member 30. Neck member 30 further includes a hole opening 36 being located in the center area 37 for receiving a securing tie 38. Hook member 32 is used for attaching the hanging package display unit 10 to a display rack 18, as shown in FIG. 6 of the drawings. Supporting bar member 39 within slot opening 34 is used for receiving and holding the hook member 52 of the lower second hanger 40.

The lower second hanger 40 includes a pair of hanger arm holding members 42 and 44, each having inner ends 46 and 48, respectively, as shown in FIGS. 1 and 2 of the drawings. Each of the inner ends 46 and 48 are integrally connected to the neck member 50. Neck member 50 includes a hook member 52 being located at the upper end 53 of neck member 50. Neck member 50 also includes a slot opening 54 being located at the lower end 55 of neck member 50. Neck member 50 further includes a hole opening 56 being centrally located in the center area 57 for receiving a securing tie 38 (if a third hanger is attached). Hook member 52 is used for hanging on supporting bar member 39 of the upper first hanger 20 in order to interlock the upper and lower hangers 20 and 40 together. The securing tie 38 prevents both hangers 20 and 40 from separating. Slot opening 54 is used for receiving the hook member of a third hanger (not shown) if used.

Figure 3:
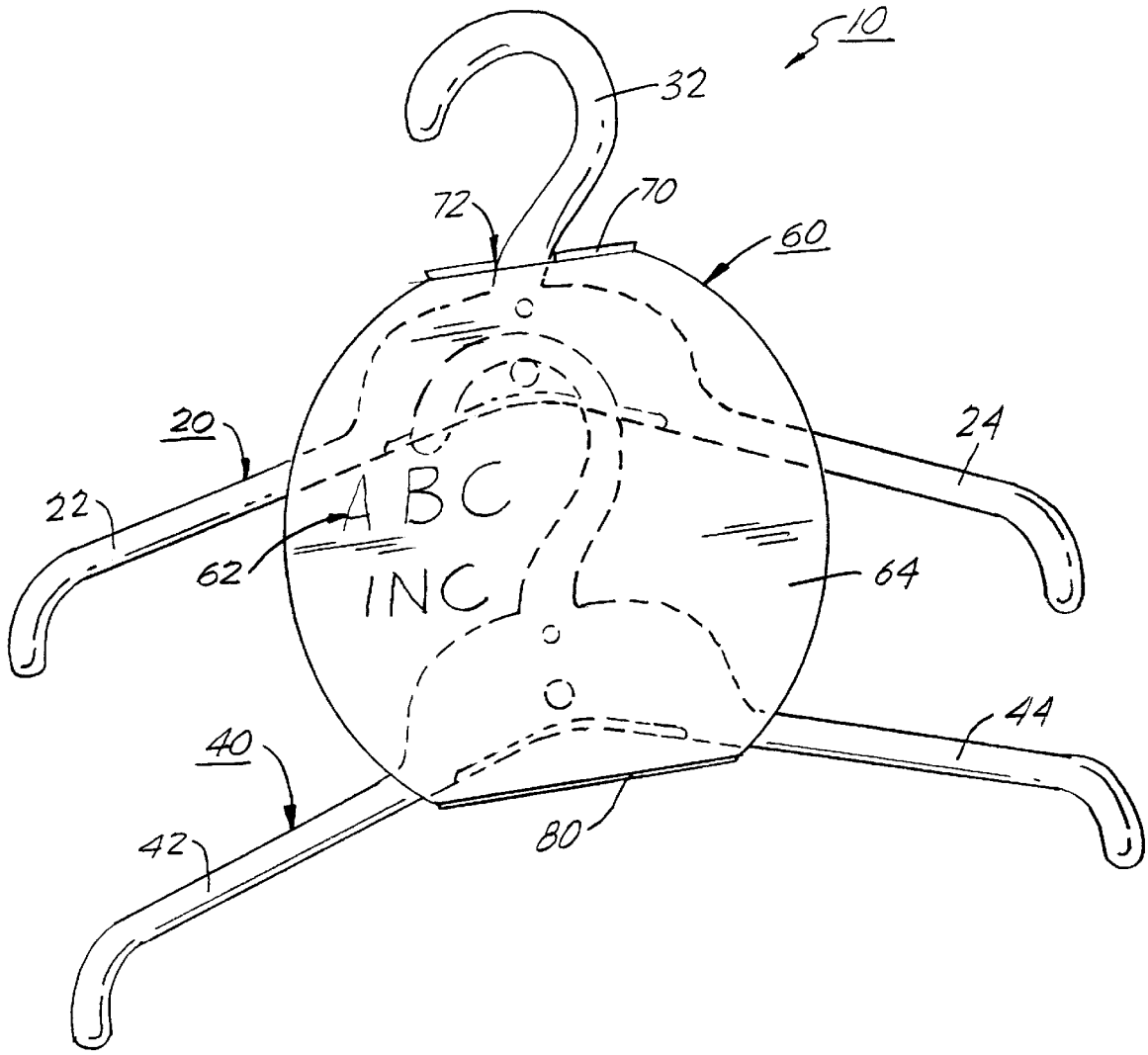
FIG. 3 is a front perspective view of the hanging package display unit of the preferred embodiment of the present invention showing the upper and lower hangers interlocked and held together by a surrounding packaging display card having indicia thereon.

The packaging display card 60, as shown in FIGS. 3 to 5 of the drawings, includes a central front wall 64 for receiving indicia 62 thereon, an upper flap member 66 with an interlocking upper tab section 68 and a first fold section 70 for connecting the central front wall 64 and the upper flap member 66. Fold section 70 includes a rectangular opening 72 for receiving hook member 32 therethrough. Display card 60 further includes a lower flap member 76 with an interlocking lower tab section 78 and a second fold section 80 for connecting the central front wall 64 and the lower flap member 76. Interlocking tab sections 68 and 78 are joined together for closing the upper and lower flap members 66 and 76, respectively, on the display card 60, as shown in FIG. 4 of the drawings, for surrounding the upper and lower hangers 20 and 40 in order to hold together both hangers 20 and 40 securely in place in order to form the assembled hanging package display unit 10.

It should be understood that the hanging packaging display unit 10 of the present invention can be used without a display card 60, as shown in FIGS. 1 and 2 of the drawings, where securing tie 38 is used to hold the upper and lower hangers 20 and 40 together as depicted. It should also be understood that no securing tie 38 is needed when using the packaging display card 60 for surrounding the upper and lower hangers 20 and 40 in order to hold together both hangers 20 and 40 in a firm manner, as shown in FIGS. 3 to 5 of the drawings. Additionally, packaging display card 60 can be used to mount and display other items such as clothing accessories, toys, booklets, jewelry and the like, as shown in FIG. 6 of the drawings. Also, display card 60 can be used in an advertising and display venue only without mounting any other products thereon, as shown in FIG. 3 of the drawings.

FIRST ALTERNATE EMBODIMENT 100

Figure 7:
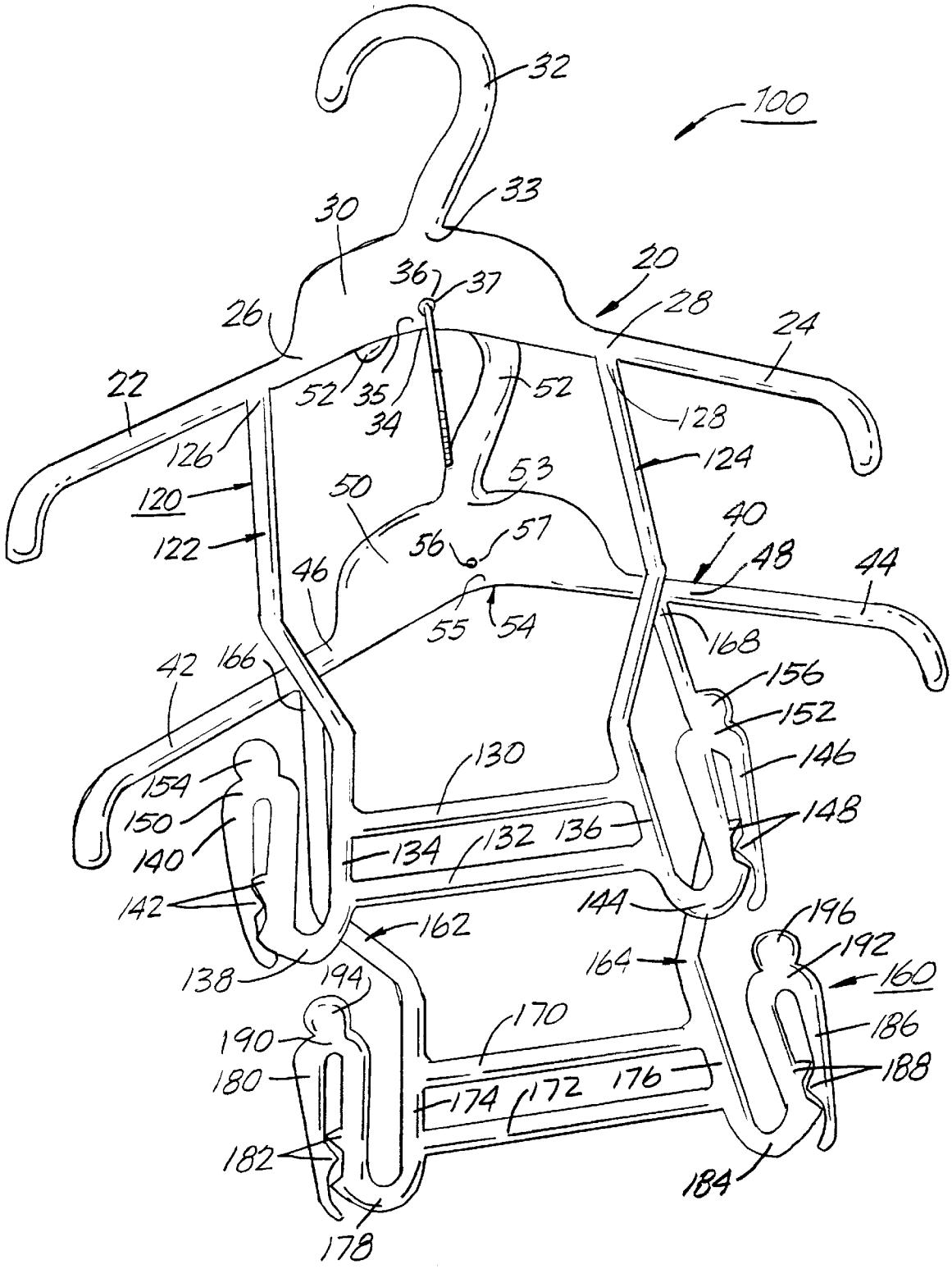
FIG. 7 is a perspective view ofthe hanging package display unit ofthe first alternate embodiment of the present invention showing the upper and lower hangers interlocked with each hanger having a hanging bracket.
Figure 8:
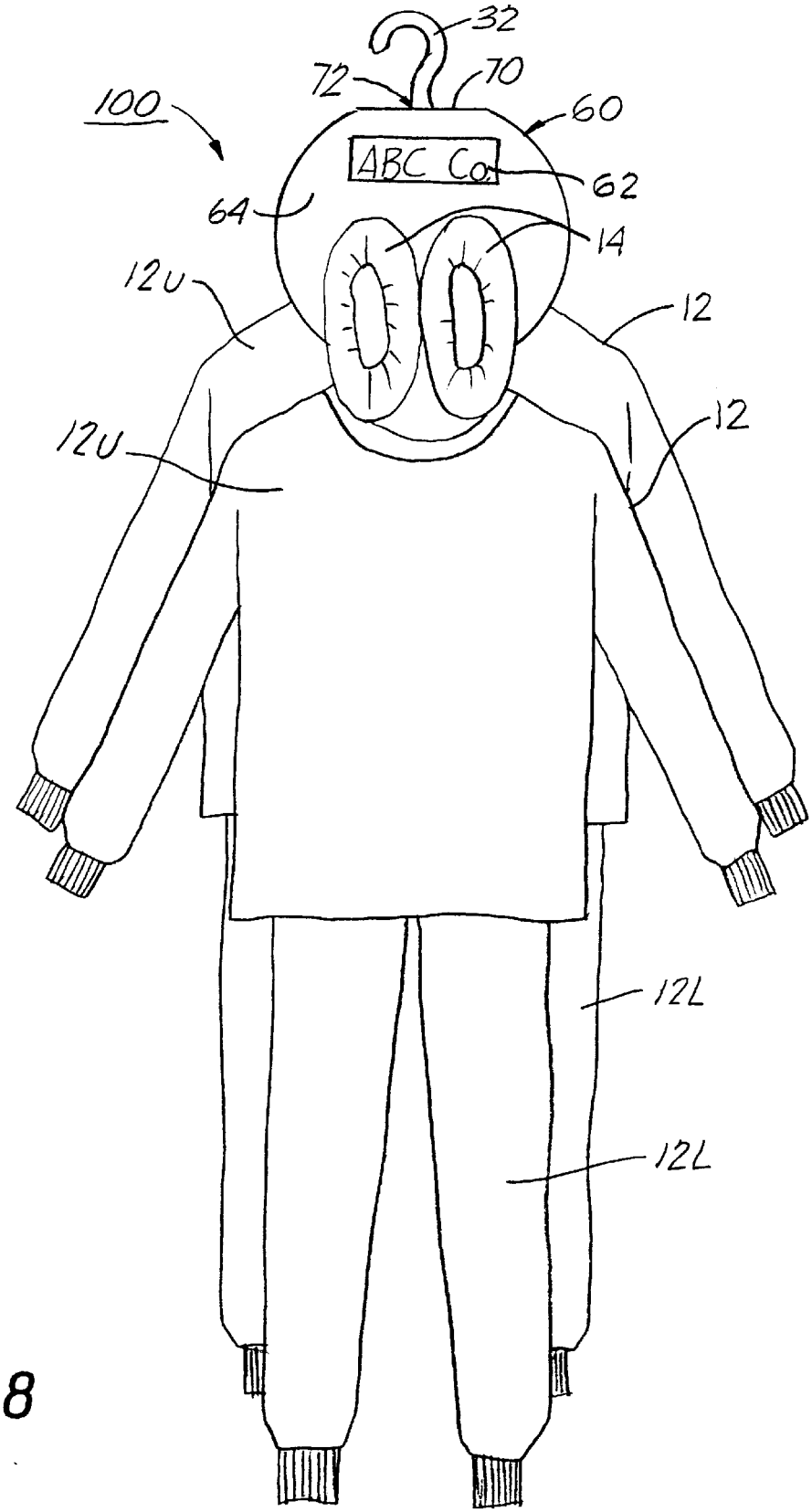
FIG. 8 is a front view of the hanging package display unit of the first alternate embodiment of the present invention showing the packaging display card thereon and in operational use.
Figure 9:
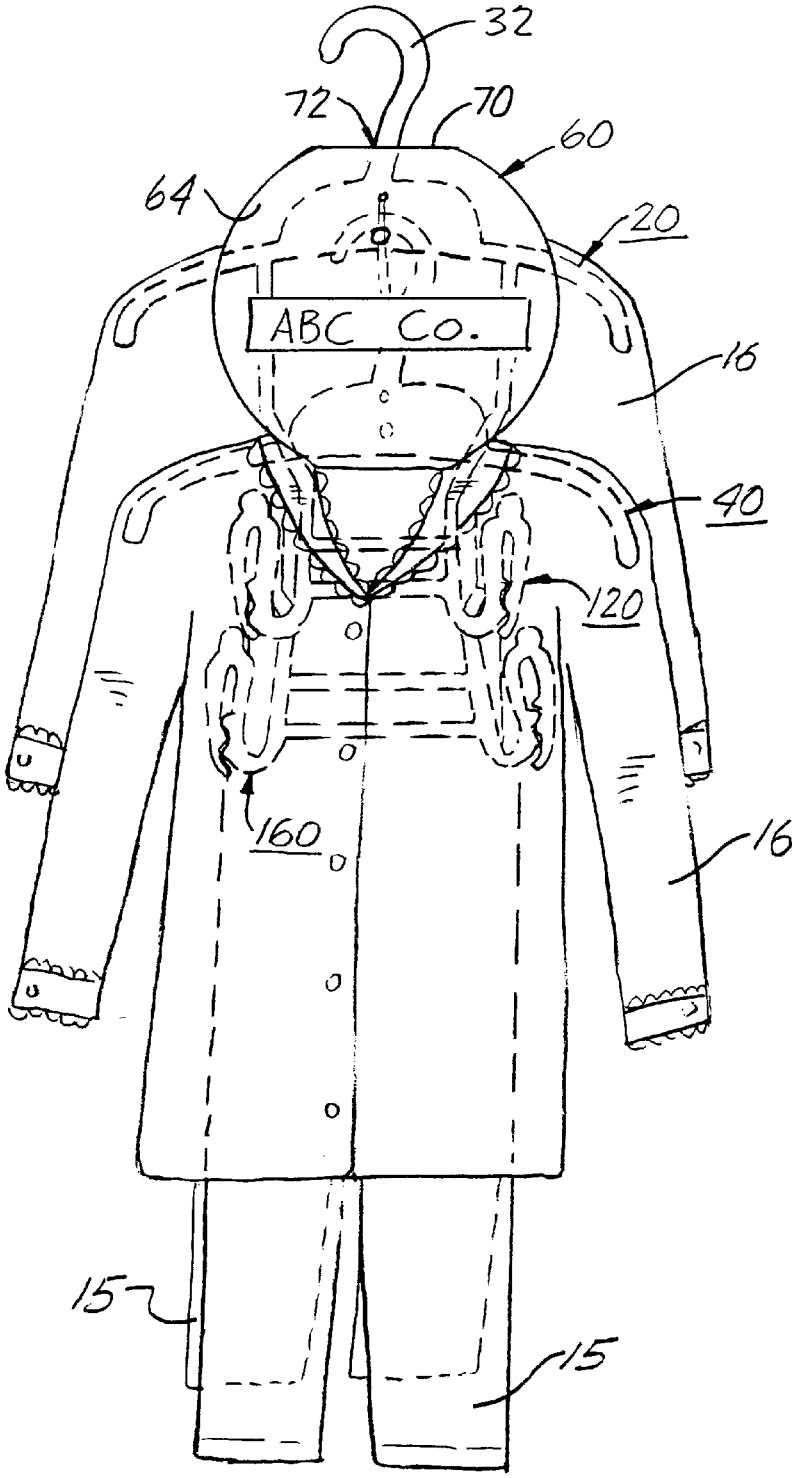
FIG. 9 is a front view of the hanging package display unit of the first alternate embodiment of the present invention showing the upper and lower hangers in dotted lines and having the packaging display card thereon in operational use.

The hanging packaging display unit 100 of the first alternate embodiment, as shown in FIGS. 7 to 9, is used for displaying a plurality of paired or matching clothing articles such as upper and lower portions 12U and 12L of sleepwear or underwear 12, and the display card 60 can include slippers 14 mounted thereon. The hanging package display unit 100, as shown in FIGS. 7 and 8 of the drawings, includes a first (upper) hanger 20 having a first (upper) hanging bracket 120 thereon and a second (lower) hanger 40 having a second (lower) hanging bracket 160 thereon, where the lower second hanger 40 is interlocked below the upper first hanger 20. The hook member 52 of the interlocked lower second hanger 40 is received on supporting bar member 39 within slot opening 34 in neck member 30 of the upper first hanger 20, and the upper and lower hangers 20 and 40 have hanging brackets 120 and 160 thereon, respectively. Hangers 20 and 40 with hanging brackets 120 and 160, respectively, are also held together by the surrounding packaging display card 60 having indicia 62 thereon in order to form the assembled hanging package display unit 100.

The first (upper) hanging bracket 120, as shown in FIG. 7, includes a pair of vertical connecting members 122 and 124 being connected at the upper ends 126 and 128 of vertical connecting members 122 and 124 to each of the inner ends 26 and 28 of hanger arm holding members 22 and 24, respectively, of upper hanger 20. Hanging bracket 120 also includes a pair of horizontal hanging bar members 130 and 132 being connected at the lower ends 134 and 136 of vertical connecting members 122 and 124, respectively, for hanging of additional clothing articles thereon. Each of the lower ends 134 and 136 of vertical connecting members 122 and 124 further includes a hook section 138 and 144, and a clothing clasp section 140 and 144, a clothing clasp section 140 and 146 having clasping points 142 and 148 thereon for holding and displaying skirts, shorts and other garments thereon. The upper ends 150 and 152 of each clasp section 140 and 146 include integrally attached circular tabs 154 and 156 thereon, respectively. Circular tabs 154 and 156 are used for tying off an article of clothing to each of those tabs 154 and 156, respectively.

The second (lower) hanging bracket 160, as shown in FIG. 7, includes a pair of vertical connecting members 162 and 164 being connected at the upper ends 166 and 168 of vertical connecting members 162 and 164 to each of the inner ends 46 and 48 of hanger arm holding member 42 and 44, respectively, of lower hanger 40. Hanging bracket 160 also includes a pair of horizontal hanging bar members 170 and 172 being connected at the lower ends 174 and 176 of vertical connecting members 162 and 164, respectively, for hanging of additional clothing articles thereon. Each of the lower ends 174 and 176 of vertical connecting members 162 and 164 further includes a hook section 178 and 184, and a clothing clasp section 180 and 186 having clasping points 182 and 188 thereon for holding and displaying skirts, shorts, and other garments thereon. The upper ends 190 and 192 of each clasp section 180 and 186 include integrally attached circular tabs 194 and 196 thereon, respectively. Circular tabs 194 and 196 are used for tying off an article of clothing to each of those tabs 194 and 196, respectively.

It should be understood that the hanging packaging display unit 100 of the present invention can be used without a display card 60, as shown in FIG. 7 of the drawings, where securing tie 38 is used to hold the upper and lower hangers 20 and 40 together as depicted. It should also be understood that no securing tie 38 is needed when using the packaging display card 60 for surrounding the upper and lower hangers 20 and 40 in order to hold together both hangers 20 and 40 in a firm manner, as shown in FIGS. 8 and 9 of the drawings. Additionally, packaging display card 60 can be used to mount and display other items such as clothing accessories, toys, booklets, jewelry and the like, as shown in FIG. 8 of the drawings. Also, display card 60 can be used in an advertising and display venue only without mounting any other products thereon, as shown in FIG. 9 of the drawings.

SECOND ALTERNATE EMBODIMENT 200

Figure 10:
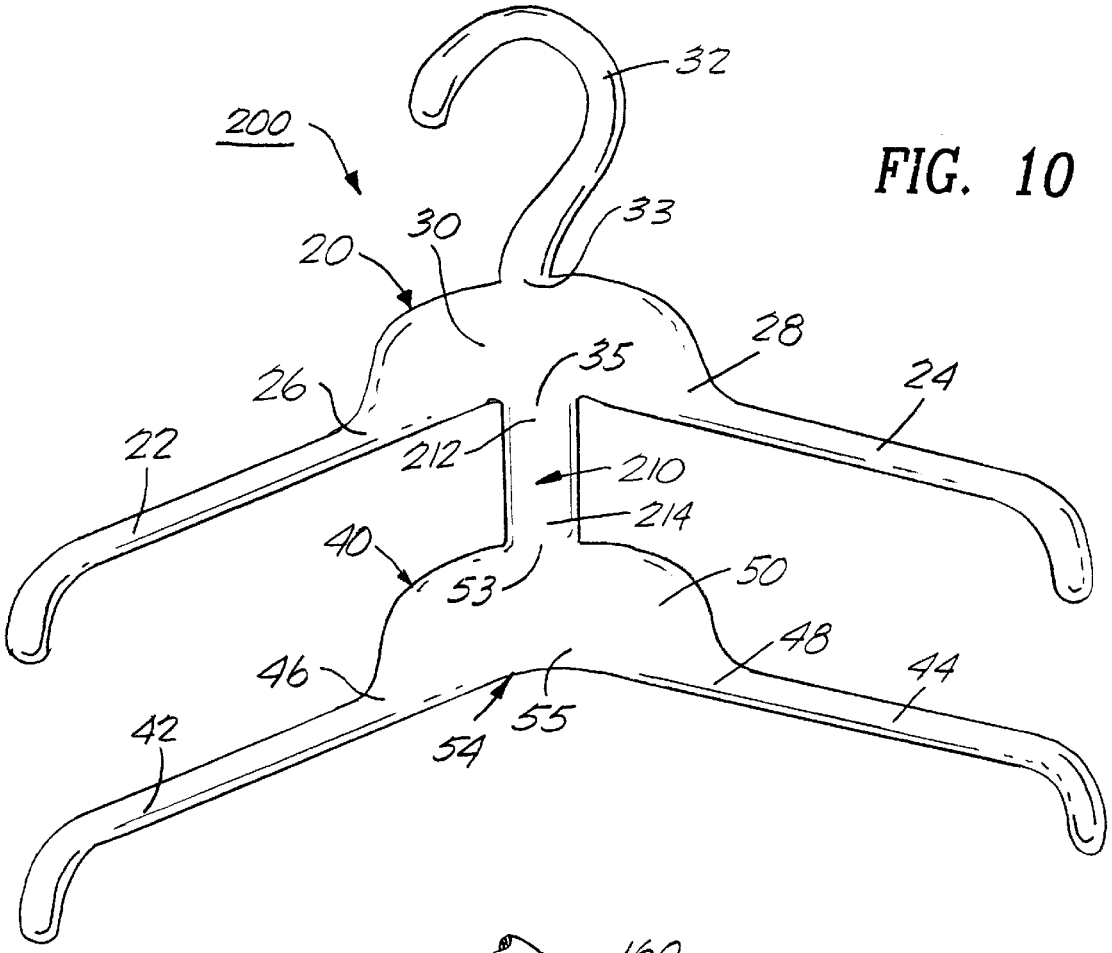
FIG. 10 is a perspective view of the hanging package display unit of the second alternate embodiment of the present invention showing the upper and lower hangers being integrally molded as a single unit.

The hanging package display unit 200 and its component parts of the second alternate embodiment of the present invention are represented in detail by FIG. 10 of the patent drawings. All aspects of the second alternate embodiment of the hanging package display unit 200 are the same as the preferred embodiment of the hanging package display unit 10 except for the vertical connecting bar member 210 having an upper end 212 and a lower end 214 for integrally attaching the upper and lower hangers 20 and 40 together. The upper end 212 is attached to lower end 33 of neck member 30 of upper hanger 20 and the lower end 214 is attached to the upper end 53 of neck member 50 of lower hanger 40. Vertical connecting bar member 210 has replaced hook member 52 of hanger 40. Hanging package display unit 200 is a single integrally molded unit made of lightweight and durable plastic.

OPERATION OF THE INVENTION

In operation, the hanging package display units 10 and 100 of the preferred and first alternate embodiments of the present invention are readily put into operational use by assembling the upper and lower hangers 20 and 40 in the following manner. The user simply inserts the hook member 50 of hanger 40 into the receiving slot opening 34 in neck member 30 of upper hanger 20. The user then inserts a suitable fastening device within circular hole opening 36 for the permanent or temporary securement of the interlocked upper and lower hangers 20 and 40, as shown in FIGS. 1 and 7 of the drawings. Fastening device can include a securing tie 38, a loop lock fastener, a cable tie, a beaded tie, and a temporary or permanent locking fastener.

Alternatively, a fastening device such as securing tie 38 need not be used, as the user can use the packaging display card 60 for securing and holding in place the upper hanger 20 relative to that of lower hanger 40, as shown in FIGS. 3 to 5 of the drawings. When using display card 60, the user simply inserts hook member 32 within rectangular slot opening 72 of fold section 70, where then the upper flap member 66 is folded downwardly over the neck member 30 of upper hanger 20, and the lower flap member 76 is folded upwardly along fold section 80 and under neck member 50 of lower hanger 40, as shown in FIGS. 4 and 5 of the drawings. In the next step the user joins together the interlocking upper and lower tab sections 68 and 78 of upper and lower flap members 66 and 76, respectively, as shown in FIG. 4 of the drawings. In this step tab sections 68 and 78 are closed, such that upper and lower flap members 66 and 76 and central front wall 64 surrounds neck members 30 and 50 of upper and lower hangers 20 and 40, respectively, in order to hold together both hangers 20 and 40 securely in place in order to form the assembled hanging package display units 10 and 100, as shown in FIGS. 6, 8 and 9 of the drawings. The second alternate embodiment of the hanging package display unit 200 needs no assembly, as it is a single molded unit as shown in FIG. 9 of the drawings.

Figure 9A:
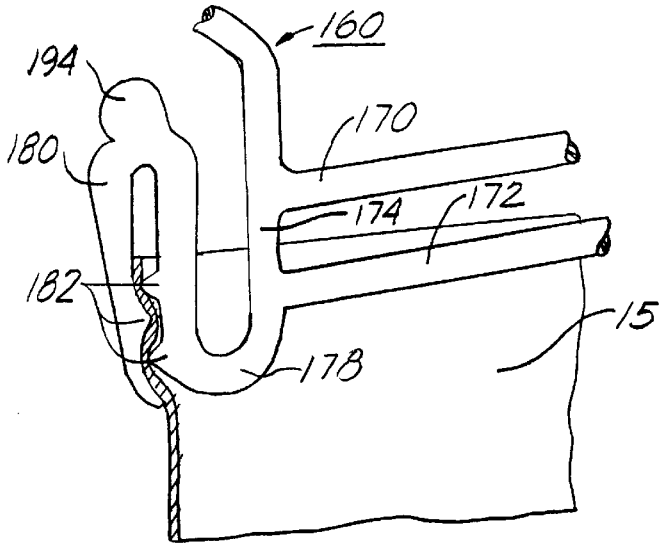
FIG. 9A is an enlarged partial cut-away view of the hanging package display unit of the first alternate embodiment of the present invention showing the clasping points of the clasp section of the lower hanging bracket of the lower hanger in operational use.

Now the user is able to assemble various clothing articles on the hanging package display units 10, 100 or 200, as shown in FIGS. 6, 8 and 9 of the drawing. The user simply places two (2) clothing articles on hanger arm holding members 22,24,42 and 44 of hangers 20 and 40, respectively. In using the hanging package display unit 100, the user can use hanging brackets 120 and 160 for securing and displaying additional garments like pants, slacks 15, shirts 16, shorts, sleepwear bottoms 12L and the like thereon. Hook sections 138, 144, 178 and 184, clasp sections 140, 146, 180 and 186 or tabs 154, 156, 194 and 196 of hanging brackets 120 and 160, respectively, are all available for securely holding or tying off various articles of clothing, as shown in FIG. 9A of the drawings.

Additionally, packaging display card 60 can also be used to mount and display other consumer product items including clothing accessories, such as bow ties 17 or slippers 14; or other consumer items, such as toys, booklets, jewelry, and the like. These items can be mounted on the central front wall 64 of display card 60 by fastening means that include securing ties 38, staples, epoxy glue, loop lock fasteners, cable ties, beaded ties and the like.

ADVANTAGES OF THE PRESENT INVENTION

Accordingly, an advantage of the present invention is that it provides for a hanging package display unit for displaying multiple units of various clothing articles, such as underwear and bras, blouses and slacks, shirt and pants, pants suits (for women) and the like.

Another advantage of the present invention is that it provides for a hanging package display unit that displays two or more clothing articles on multiple hangers for hanging on a display rack.

Another advantage of the present invention is that it provides for a hanging package display unit that includes a first hanger and a second hanger interlocked below the first hanger, where the interlocked second hanger is received within a slot opening in the neck member of the first hanger.

Another advantage of the present invention is that it provides for a hanging package display unit where the two interlocked hangers are held together by a surrounding packaging display card having advertising and/or display indicia thereon.

Another advantage of the present invention is that it provides for a hanging package display unit where the two connected hangers are held together by a security tie within a hole opening in the neck member of the first hanger.

Another advantage of the present invention is that it provides for a hanging package display unit that includes a hanging bracket member integrally attached to each of the two interlocked hangers for hanging at least four articles of clothing thereon.

Another advantage of the present invention is that it provides for a hanging package display unit where the packaging display card may display additional clothing and nonclothing accessories such as matching slippers, neckties, toys, booklets and the like being mounted on the front side of the packaging display card.

Another advantage of the present invention is that it provides for a hanging package display unit wherein the materials of construction are selected from the group consisting of plastics, wood, paper and light-weight metals.

A further advantage of the present invention is that it provides for a hanging package display unit that can be mass produced in an automated and economical manner and is readily affordable to the clothing manufacturer or retailer.

A latitude of modification, change, and substitution is intended in the foregoing disclosure, and in some instances, some features of the invention will be employed without a corresponding use of other features. Accordingly, it is appropriate that the appended claims be construed broadly and in a matter consistent with the spirit and scope of the invention herein.

What is claimed is:

1. A hanging package display unit for holding and displaying multiple clothing articles, comprising:

a) a first hanger including a pair of an holding members being attached to a central neck member; said neck member having a hook member formed thereon;

b) a second hanger including a pair of arm holding members being attached to a central neck member;

c) said second hanger being disposed below and spaced apart from said first hanger; connecting means for vertically connecting said first and second hangers for securely holding together said first and second hangers;

d) said first and second hangers for holding and displaying multiple clothing articles; and e) a packaging display card for partially surrounding and covering said first and second hangers, wherein said packaging display card includes a central front wall, an upper flap member having a first interlocking tab thereon and a lower flap member having a second interlocking tab thereon for securing together said first and second hangers.

2. A hanging package display unit in accordance with claim 1, wherein said connecting means for connecting are selected from the group consisting of a securing tie, a loop lock fastener, a cable tie, a beaded tie, a temporary locking fastener, a permanent locking fastener, a packaging display card, and combinations thereof.

3. A hanging package display unit in accordance with claim 1, wherein said first and second hangers each include a hanging bracket integrally attached thereto for holding additional clothing articles.

4. A hanging package display unit for holding and displaying multiple clothing articles, comprising:

a) a first hanger including a pair of arm holding members being attached to a central neck member; said neck member having a hook member and a receiving slot opening formed therein;

b) a second hanger including a pair of arm holding members being attached to a central neck member; said neck member having a hook member;

c) said second hanger being disposed below and spaced apart from said first hanger and connected thereto; wherein said hook member of said second hanger is received within said slot opening of said first hanger;

d) connecting means for connecting and for securely holding together said first and second hangers; wherein said connecting means is a packaging display card for partially surrounding said first and second hangers in order to hold together both of said first and second hangers securely in place;

e) wherein said packaging display card includes a central front wall, an upper flap member having a first interlocking tab thereon and a lower flap member having a second interlocking tab thereon for securing together said first and second hangers; and f) said first and second hangers for holding and displaying multiple clothing articles.

5. A hanging packaging display unit in accordance with claim 4, wherein said first and second interlocking tabs are joined together to close said packaging display card around said first and second hangers.

6. A hanging package display unit for holding and displaying multiple clothing articles comprising:

a) a first hanger including a pair of arm holding members being attached to a central neck member; said neck member having a hook member and a receiving slot opening formed therein;

b) a second hanger including a pair of arm holding members being attached to a central neck member; said neck member having a hook member;

c) said second hanger being disposed below and spaced apart from said first hanger and connected thereto; wherein said book member of said second hanger is received within said slot opening of said first hanger;

d) connecting means for collecting and for securely holding together said first and second hangers; wherein said connecting means is a securing tie member and a packaging display card for partially surrounding said first and second hangers in order to hold together both of said first and second hangers securely in place; and e) said first and second hangers for holding and displaying multiple clothing articles.

7. A hanging package display unit for holding and displaying multiple clothing articles, comprising:

a) a first hanger including a pair of arm holding members being attached to a central neck member; said neck member having a took member formed thereon;

b) a second hanger including a pair of arm holding members being attached to a central neck member;

c) said second hanger being disposed below and spaced apart from said First hanger; connecting means for vertically connecting said first and second hangers for securely holding together said first and second hangers;

d) said first and second hangers for holding and displaying multiple clothing articles; and e) a packing display card for partially surrounding and covering said first and second hangers, wherein said packaging card includes a central front wall member, a first member connected to one end of said central front wall member and having a first locking device thereon and a second member connected to the other end of said central front wall member and having a second locking device thereon, said first and second locking devices being removably interlocked for securing together said first and second hangers.

* * * * *

Disclaimer 6,209,763—Jack Rahmey, 220 Monmouth Rd., Oakhurst, NJ (US) 07755. HANGING PACKAGE DISPLAY UNIT. Patent dated Apr. 3, 2001. Disclaimer filed Jun. 6, 2003, by the Inventor.

Hereby enters this disclaimer to claims 1-7, of said patent.

*(Official Gazette, October 7, 2003)*